United States Patent [19]

Kuzuno et al.

[11] Patent Number: 4,902,240

[45] Date of Patent: Feb. 20, 1990

[54] MULTI-TERMINAL CONNECTOR

[75] Inventors: Katsutoshi Kuzuno; Shigeo Ishizuka; Kazuaki Sakurai, all of Shizuoka, Japan

[73] Assignee: Yazaki Corporation, Tokyo, Japan

[21] Appl. No.: 295,338

[22] Filed: Jan. 10, 1989

[30] Foreign Application Priority Data

Jan. 14, 1988 [JP] Japan ..... 63-4951

[51] Int. Cl.[4] ..... H01R 13/62

[52] U.S. Cl. ..... 439/157

[58] Field of Search ..... 439/152–160

[56] References Cited

U.S. PATENT DOCUMENTS 3,488,622 1/1970 Gley ..... 439/157

3,778,747 12/1973 Curcic ..... 439/157

4,332,432 6/1982 Colleran ..... 439/157

*Primary Examiner*—Joseph H. McGlynn

*Attorney, Agent, or Firm*—Armstrong, Nikaido, Marmelstein, Kubovcik & Murray

[57] ABSTRACT

A multi-terminal connector comprising a male housing having a plurality of female terminals stored therein, a female housing having a plurality of male terminals stored therein and provided with an enlarged body for accomodating the male housing, a plurality of guide rails including at least two main guide rails and one supporting rail running in parallel therebetween disposed along the longer side of the enlarged body of the female housing, and also intersecting at right angles against the axis of the male terminals, a pair of sliders each slidably engageable with the guide rails, having a cam follower downwardly projecting from the lower surface thereof, a longitudinal slot formed between the above at least two of rails for permitting each of the cam followers to protrude therethrough, a pair of cam tracks arranged in the upper surface of the male housing and symmetrically extending in a diagonally rearward direction from lateral ends thereof to engage with the respective cam followers through the slot.

21 Claims, 18 Drawing Sheets

MULTI-TERMINAL CONNECTOR

BACKGROUND OF THE INVENTION

Field of the Invention

The present invention relates to a multi-terminal connector composed of a male and a female housings provided with a plurality of female terminals and male terminals respectively therein to be connected to or disconnected from each other by a considerably small force owing to a cam mechanism adopted therein.

A hither-to-known multi-terminal connector of this type is already disclosed in the U.S. Pat. No. 4,586,771, which comprises a first housing containing a pair of longitudinally aligned slots, a second housing containing a cam track, and a slider provided with a cam follower protruding from the lower surface thereof for moving along the cam track through the above aligned slots.

The above slider is formed in an U shape composed of a web and a pair of arms extending therefrom in parallel, the length of the both arms being equal to the distance between the edge walls of the flange formating a hood in the first housing for accomodating the second housing, wherein the above cam follower is projecting inwardly of the arms.

Consequently, for engaging the first housing with the second one by utilization of the above cam mechanism, the slider must be inserted at right angles to the engaging direction, that is, an ample space at least wider than the length of the slider itself is required at one side of the connector as it must be inserted therefrom, thus the space for its installation cannot securely be obtained in a limited space such as inside the instrument panel of a car, its operability thus is not sufficiently high.

Also as the rotational moment is generated due to the distance between the web for enforcing the slider to slide and the cam follower for moving along the cam track, a relatively large force is required for engagement or separation of the two housings. Besides, although a pair of aligned guide slots are arranged for preventing the slider from rotating, the engaging force is likely to be applied bias towards one side to cause ricketiness due to the fact that those two cam tracks are inclined at same degree.

It is therefore an object of the present invention to provide a multi-terminal connector of the structure in which easy engagement or separation can be performed even in a limited narrow space, yet with a relatively small force.

It is also another object of the present inevention to provide a multi-terminal connector of the structure in which the state of the engagement between the male and female housings can be easily confirmed, with the function that they are also locked in a perfectly engaged state so as to be attached to the wall of a panel, an electric connection box and so on.

SUMMARY OF THE INVENTION

In order to achieve the above first object, the applicant has provided a multi-terminal connector of the first functional structure mainly composed of a female housing that stores a plurality of male terminals and a male housing that stores a plurality of female terminals for engaging with each other so as for the both housings to be electrically connected, comprising a pair of guide rails intersecting at right angles against the axis of the terminals at one edge wall of the longer side of the enlarged body of the female housing for accomodating the male housing, a pair of sliders having insertion grooves, each one slidably engageable with a pair of guide rails and a cam follower downwardly projecting from the lower end portion thereof, a longitudinal aligned slot formated between the rails at the top end portion of the enlarged body of the female housing for permitting each of the cam followers to protrude therethrough, a pair of symmetrical cam tracks for receiving the cam followers penetrating through the respective slots, which are arranged on the edge wall of the male housing and each one having an entrance extending diagonally backwards from lateral ends of a surface which is disposed for engaging with the female housing 1. The cam track in this case can be formed as one track by connecting the both thereof. By the above structure, male housing can be engaged with or separated from the female housing by shifting operation of the pair of sliders along the guide rails.

For easy operation of the initial stage of the engagement of these two housings, a locking means for retaining the slider at the open state (wherein the two sliders are at far end from each other) is arranged between the above pair of sliders and the female housing.

Besides, in order to prevent the above engaged housings from disengaging from each other or to confirm the engaging state thereof, another locking means for retaining the slider at the closed state (wherein the two sliders are connected to each other) is also disposed.

The above mentioned second object is achived by the multi-terminal connector of the second functional structure according to the present invention being characterized in that the above sliders are respectively provided with a locking member to engage with the wall of a panel or the like, whereby those sliders are securely attached to the above wall when they are located at the closed state, in other words, when the engagement of the two housings is perfectly achieved.

In the first type of the connector, a pair of sliders are premounted on the enlarged body of the female housing for engaging or disengaging operation of the two housings.

Therefore, the troublesome work of mounting the sliders from one side of the connector can be omitted, and it can be thus operated in a space of the size just as large as that of the housing.

A pair of sliders are respectively provided with a cam follower to engage with the cam track which is arranged on the male housing and having an entrance at both side edges of the upper surface thereof, whereby these sliders can move along the cam track symmetrically towards center portion thereof or to the reverse direction. The rotational moment generated by the pair of cam followers and applied to the male housing is thus offset, thereby smooth engagement and separation of the both housings are performed without causing ricketness. Such is the case that the both housings are accessed to each other by drawing both of the sliders towards each other using a thumb and other fingers of one hand, and the engaging operation thus can be easily performed.

In addition, by arranging a locking means for retaining the above pair of sliders at the open state the engaging operation can be immediately started without any preparation such as setting the sliders, and also these sliders are likely to be effectively retained when the separating operation is completed.

Besides, with another locking means for retaining the pair of sliders at the closed state, the engaging state of the both housings can be judged from the locking state thereof so as to retain the housings from respective disengagement.

In the second type of the connector, only when the engagement of the housings is completed, the catching member of the slider can be attached to the wall of the connector, so that confirmation of the engaging state of the both housings, and locking operation of the sliders and the both housings can be simultaneously achieved.

BRIEF DESCRIPTION OF THE DRAWINGS

FIGS. 15A and 15B are plan views of the female housing in the fourth embodiment, wherein FIG. 15A shows the sliders 3A and 3B located at the open state thereof, while FIG. 15B shows them at the closed state;

DETAILED DESCRIPTION OF THE EMBODIMENTS

Figure 1:
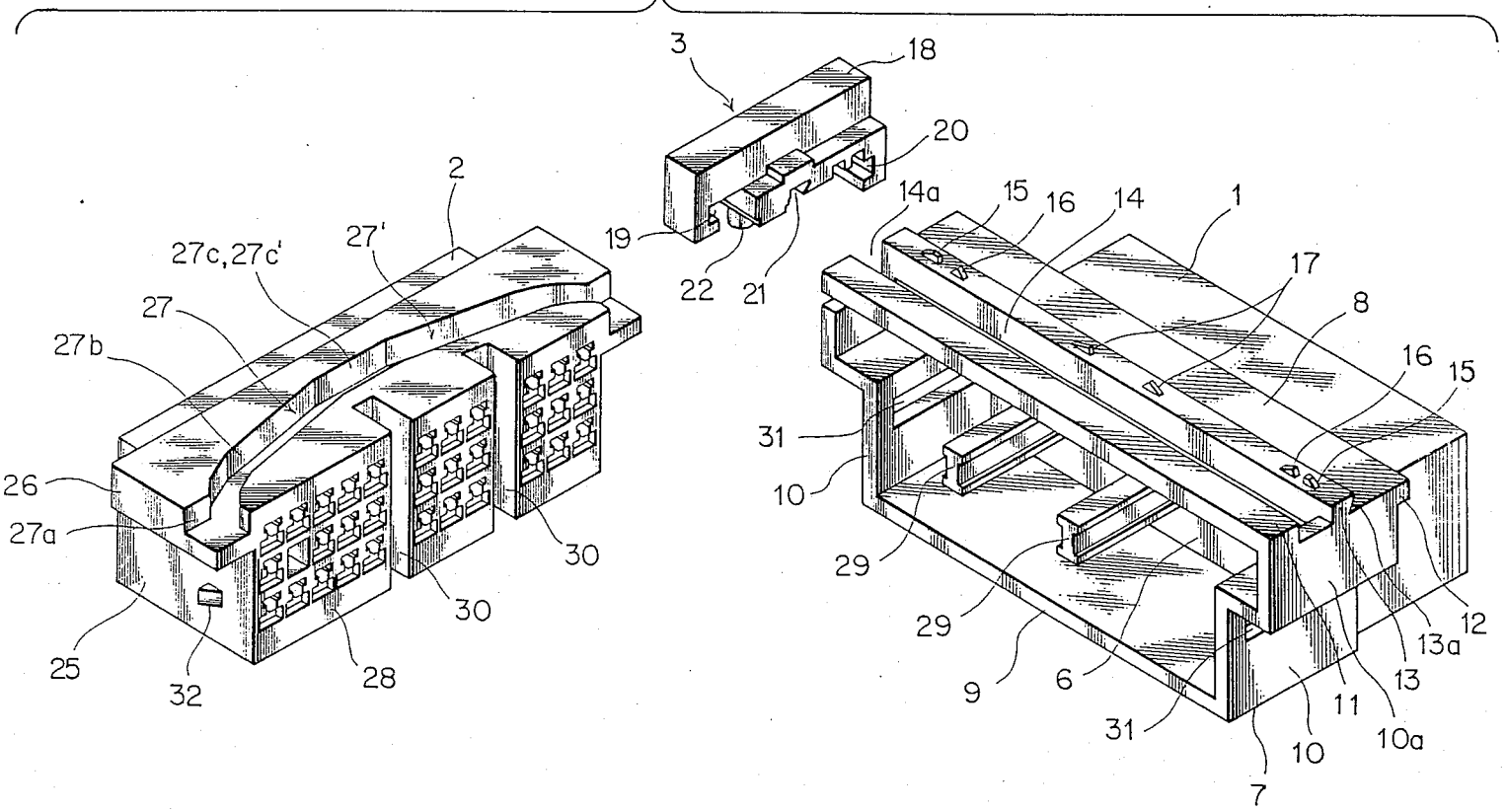
FIG. 1 is an exploded perspective view showing the first embodiment according to the first functional structure.

Embodoments of the multi-terminal connector according to the present invention are explained below referring to the drawings.

Figure 5:
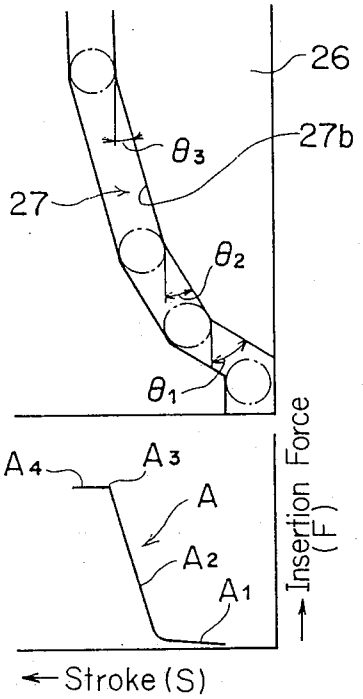
FIG. 5 is a graph showing the relation between the inclining degree of the cam track and the insertion force applied to the housings as shown in FIG. 3.
Figure 2:
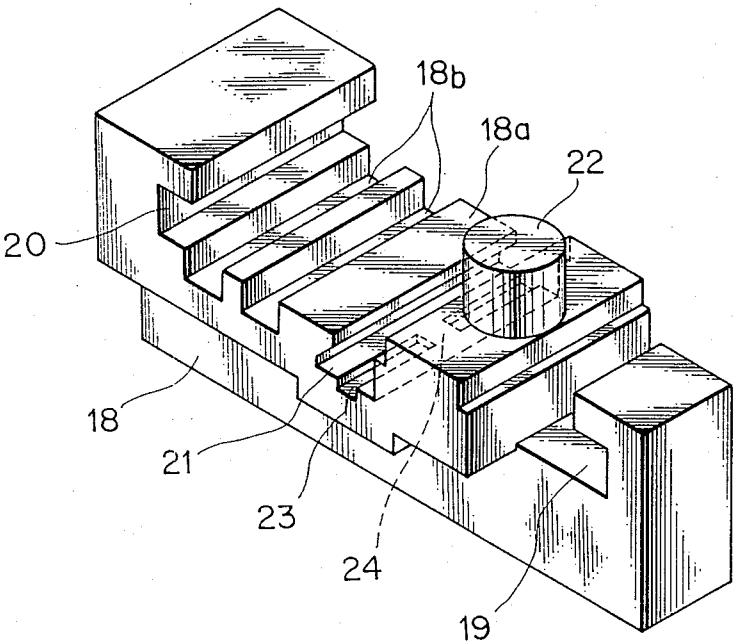
FIG. 2 is an enlarged perspective view showing the state underneath of the slider.
Figure 4:
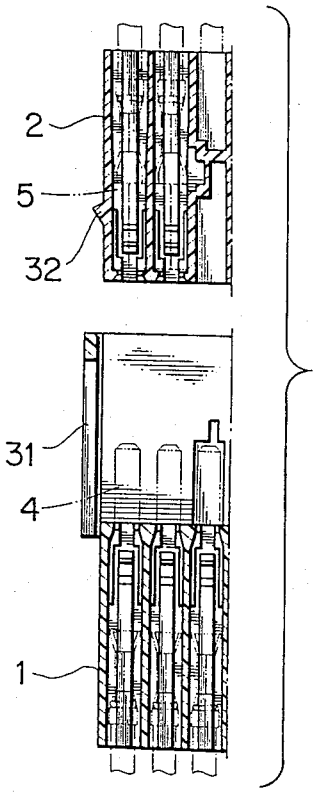
FIG. 4 is a sectional view showing the state of FIG. 3 vertically cut along the center portion thereof.
Figure 3:
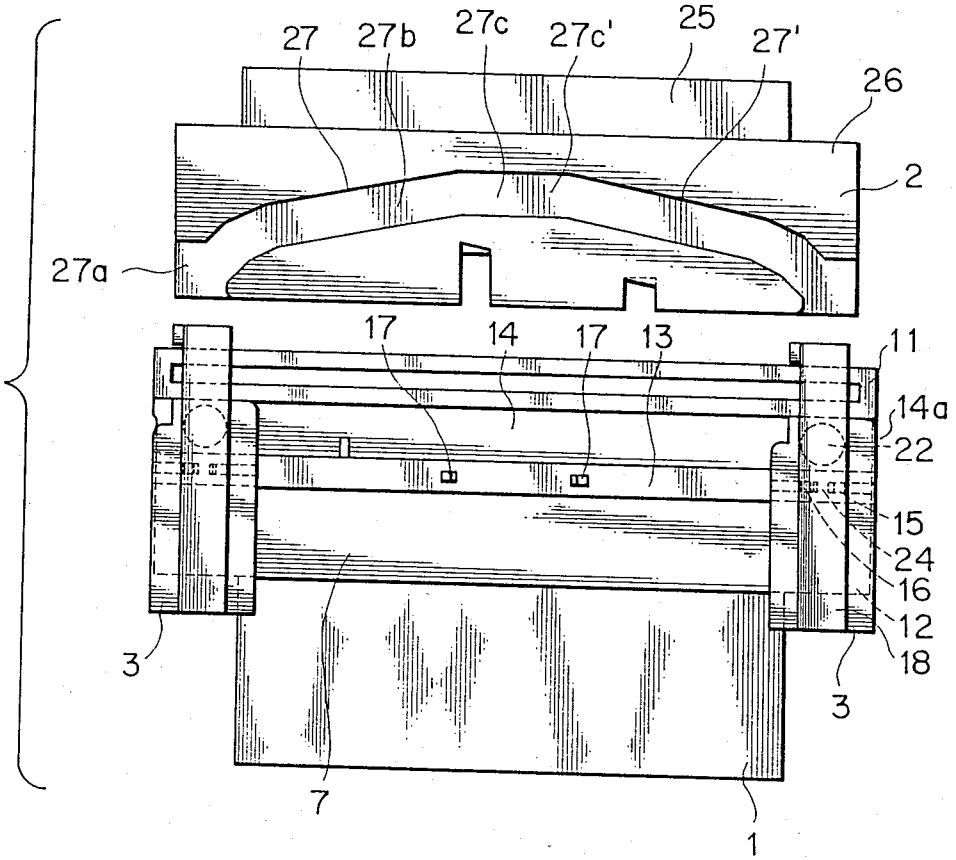
FIG. 3 is a plan view showing the state in which the sliders are mounted in the state as shown in FIG. 1.

FIG. 1 is an exploded perspective veiw of the connector according to the first functional structure, FIG. 2 is an expanded view of the slider shown in FIG. 1 seen from underneath thereof, FIG. 3 is a plan view of the slider shown in FIG. 1 at its mounted state, FIG. 4 is a sectional view of the center portion of the connector shown in FIG. 3, and FIG. 5 shows the relation between the insertion force applied to the housing and inclination level of the cam track as shown in FIG. 3.

In these figures, 1 denotes a female housing, 2 a male housing, and 3 a slider. As shown in FIG. 4, the both housings 1 and 2 accomodate a plurality of male terminals 4 and female terminals 5 respectively.

The female housing 1 contains an enlarged body 7 for accomodating the male housing 2 at the front portion of the engaging face 6 thereof. The enlarged body 7 is a frame structure composed of side walls 8 and 9 vertically facing to each other, and a pair of edge walls 10 horizontally facing to each other, the upper portion of the respective edge walls 10 forming outwardly extending portions **10*a* therefrom to be connected to each end of the upper side wall 8**.

The side wall 8 includes a pair of guide rails 11, 12 and a supporting rail 13 running in parallel with the slider 3, and also a slot 14 having an open inlet **14*a*** at one end thereof.

The rail 11 is formed one step higher than the edge wall 8 along the front edge portion thereof, and another guide rail 12 is formed extending backwardly from the edge wall 8, whereby these rails 11, 12 are structured at different levels of height. The supporting rail 13 is for preventing the slider 3 from slipping off from the edge wall 8 when it is activated to move, one side **13*a* thereof having a reverse trapozodial cross section and is disposed between the guide rails 11 and 12**.

In this structure above, the base portion of the supporting rail 13 can be any form such as T shape or the like on condition that the base portion thereof is narrower than the upper portion thereof. At least one end of the slot 14 must have an open inlet **14*a* through which the slider 3 can be mounted. This slot 14 is arranged at rather near to the guide rail 11 side in the front portion of the edge wall 8. The supporting rail 13 is provided with a pair of catching projections 15 and 16 at each end thereof forming a locking means together for retaining the slider 3 at the open state, and also another pair of projections 17** at the center portion thereof forming another locking means altogether.

The slider 3 comprises insertion grooves 19 and 20 at both ends of lower surface of the beam-like handle portion 18 but at different levels of height for engaging with the above guide rails 11 and 12, a supporting groove 21 in the middle portion of the lower surface of the handle for engaging with the supporting rail 13 arranged on the female housing 1, and a cylindrical cam follower 22 downwardly projecting between the supporting groove 21 and the insertion groove 19. At the bottom surface of the supporting groove 21 a narrow groove 23 is structured for formating a path for the above locking projections 15, 16 and 17, and a projection 24 is arranged at the center portion of the groove 23 for engaging with the above locking projections 15, 16 and 17. In this structure, it is preferable to form a plurality of small grooves **18*b* as shown in FIG. 2 in the lower surface of the handle portion 18, in other words in the surface 18*a* facing to the above side wall 8**, so as to minimize the sliding resistance.

In the male housing 2, a sidewardly expanded portion 26 for engaging with the expanded portion **10*a* of the enlarged body 7 is disposed on the upper portion of the main body 25 which is arranged for accomodating a plurality of female terminals, and a pair of cam tracks 27 and 27' are further arranged on the above expanded portions 26. TYhe cam tracks 27 and 27' respectively comprises the entrance 27*a* extending inwardly from the both edges of the surface 28 which is arranged for engaging with the female housing 1, the middle portion 27*b* extending diagonally backwards, and the end portion 27*c* which runs in parallel with the above engaging surface 28. This embodiment shows an example in which the end portions 27*c*, 27*c'* of the respective cam tracks 27, 27'** are connected so as to formate one track of a laterally symmetrical structure.

It is preferable that the angle of inclination of the middle portion **27*b* of the cam track 27 (27') is settled in such a way as to change by three levels; $\theta$ 1, $\theta$ 2 and $\theta$ 3, in the successive order from the entrance 27*a*, and the degree of these three steps are defined as $\theta 1 > \theta > \theta 3$. In other words, on engaging the two housings, where the insertion force F is still small at the beggining of the engagement, the stroke S is made rather deep by arranging the angle $\theta$ 1 quite acute, and also the width of the both housings 1 and 2**, which is the depth necessary for constructing the cam track, is minimized at the same time.

By the way, since both male and female housings 2 and 1 are largely formed in size as a multi-terminal connector, as shown in FIG. 1 it is preferable to construct a plurality of engaging guide shafts 29 in the engaging surface 5 of the female housing 1, and also to construct a corresponding concave portions 30 in the engaging surface 28 of the housing 2 for engaging with the above guide shafts 29, so that the possible ricketiness upon engaging the both housings and the irrelevant reverse engagement can be prevented. 31 and 32 are a locking hole and a locking nail forming another locking means for the both housings together.

Below explains the engagement and separation of the two housings 1, 2 by use of the slider 3.

The slider 3 should be premounted as shown in FIG. 3, by inserting the insertion grooves 19, 20 and the supporting groove 21 of the slider 3 to the corresponding guide rails 11, 12 and the supporting rail 13 from the open inlet **14*a* of the slot 14 arranged in the female housing 1**.

FIG. 3 shows the state in which the cam follower 22 of a pair of sliders 3 is guided into the slot through the open inlet **14*a* thereof and the projection 24 arranged on the small groove 23 in the suppoting groove 21 is engaged with the concave portion between the locking projections 15 and 16 situated at the respective ends of the supporting rail 13, whereby a pair of sliders 3 are respectively locked at each end of the enlarged body 7 (open state). As the slider 3 slides along the two guide rails 11, 12 and another supporting rail 13, it is not necessary for the slot 14 to guide the cam follower 22, and therefore, the width of the slot 14 can be freely chosen provided that the cam follower 22** can slidably move therein.

Figure 6:
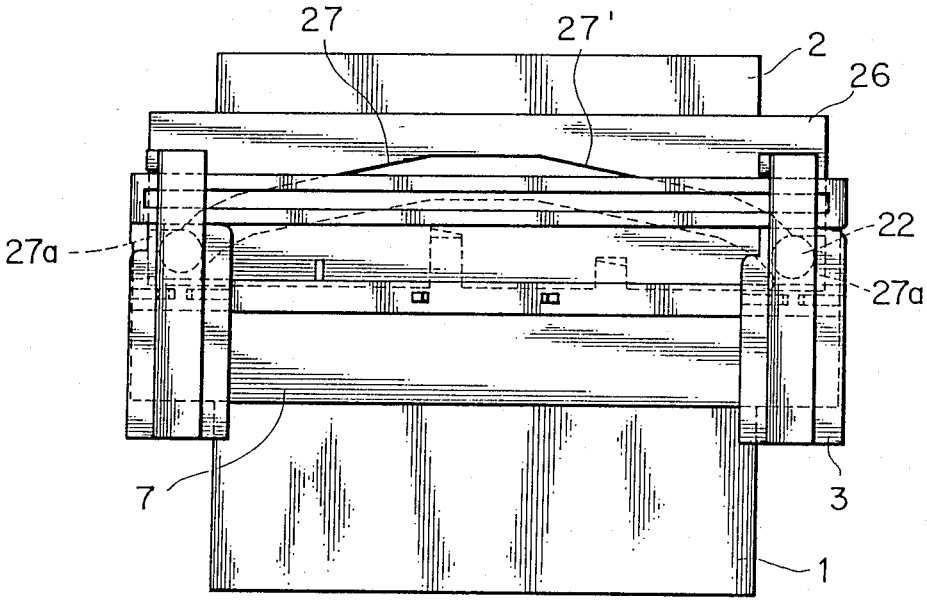
FIGS. 6 to 8 respectively shows a plan view each showing the procedure for engaging the connector.
Figure 7:
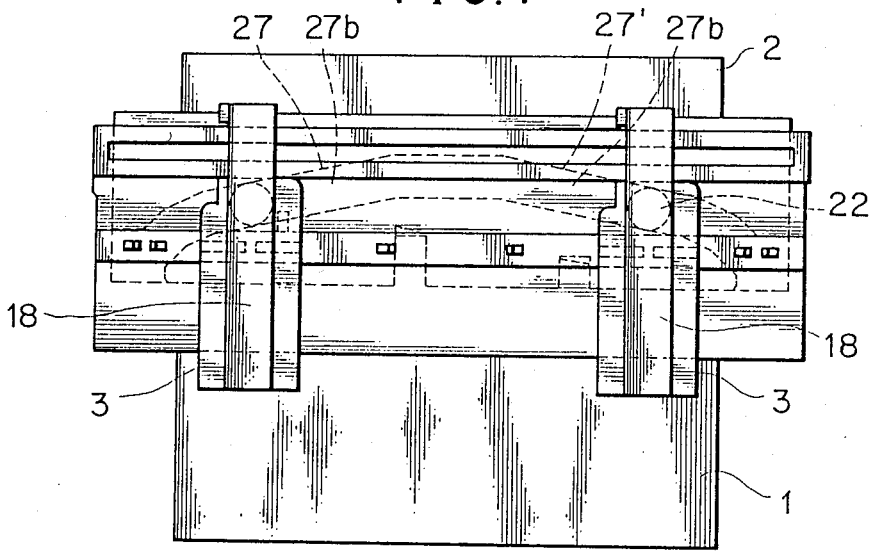
Figure 8:
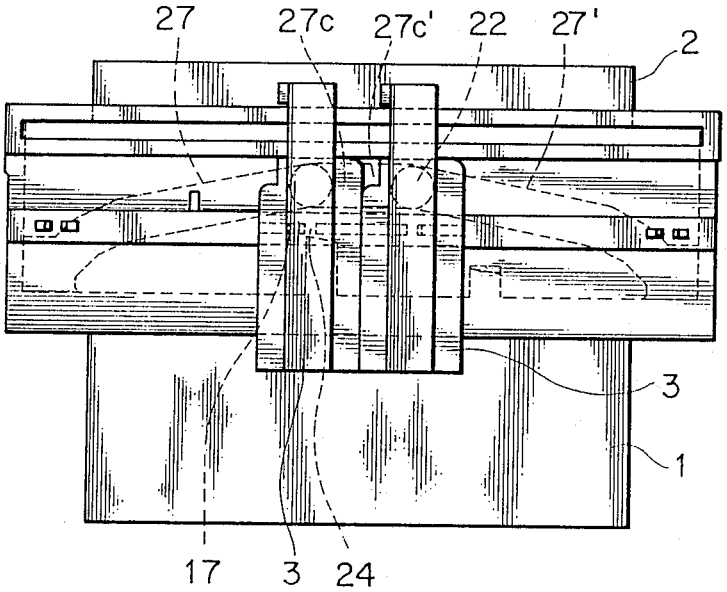

Engagement of the two housings 1 and 2 is performed as shown in FIG. 6 to FIG. 8.

First of all, the male housing 2 is inserted into the enlarged body 7 of the female housing 1. The insertion must be performed up to the point where the cam follower 22 of the slider 3 reaches the deep inner wall of the entrance **27*a* of the cam track 27 (FIG. 6). By this operation, the respective fore ends of the male and female terminals come to the point just before contacting to each other as shown in FIG. 4, then the engagement of the terminals 4 and 5, in short, that of the both housings is started, and at the same time, these housings 1 and 2 are locked by the locking means 31 and 32. Then a pair of sliders 3 can be slidably moved towards certain point therebetween by use of fingers as shown in FIG. 7. The male housing 2 is accessed to the female housing 1 by the cam rack 27 (27') along with the cam followers 22 move towards each other. Since the cam follower 22 slidingly contacts to the middle portion 27*b* of the cam track 27 (27'**) having three angles of inclination ($\theta$ 1, $\theta$ 2, $\theta$ 3), the engagement can be performed with a relatively small force.

FIG. 8 shows the state in which the engagement has been completed. The cam follower 22 is situated at the end portion **27*c* (27') of the cam track 27 (27'), and the projection 24 is situated between the locking means 17 on the center surface of the supporting rail 13, and a pair of sliders 3 are locked respectively to the enlarged body 7** of the female housing (closed state).

When the slider 3 is in the moving state from the open state to that of the closed, that is, in the middle of the engaging operation of the housing 1 and 2 as shown in FIG. 7, a force to remove the slider 3 from the enlarged body 7 is applied due to the contact resistance between a plurality of male terminals 4 and female terminals 5, buth the two sliders are perfectly connected by the engagement of the dove-tail like supporting groove 21 and the supporting rail 13. Also, since a pair of sliders 3 are symmetrically accessed to or removed from each other between the open state and the closed state thereof, the rotational moment applied to the male housing 2 by the both cam followers is offset, whereby smooth engagement and separation can be performed without occurence of the ricketiness.

As explained above, since the two sliders 3 are premounted on the female housing 1, the operator has only to activate the slider so that a troublesome work such as mounting the sliders from one side of the housing can be omitted and easy connection/disconnection is made possible. The separation of the housing from each each is realized by the reverse operation to that of the engagement.

The graph shown in FIG. 5 shows the relationship between the stroke S and engaging (insertion) force F in the engaging operation. As known from the curve A, the engaging force is minimum (Al) at the location of the angles of inclination $\theta$ 1, $\theta$ 2 in the middle portion 27*b* of the cam track 27, then abruptly increased (A2) at the location of the angle of inclination $\theta$ 3 due to the starting of the real contacting operation between the female and male terminals 4 and 5, and then attains the peak A3, and finally gets to a constant level A4 when the engagement is completed.

Figure 9A:
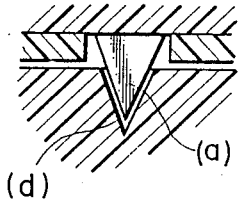
FIGS. 9A to 9C show sectional views showing different embodiments of the cam track and the cam follower.
Figure 9B:
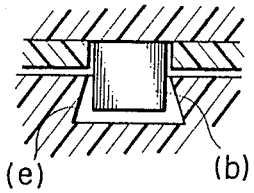
Figure 9C:
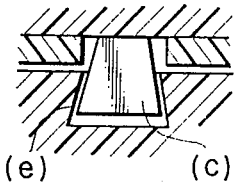
Figure 10:
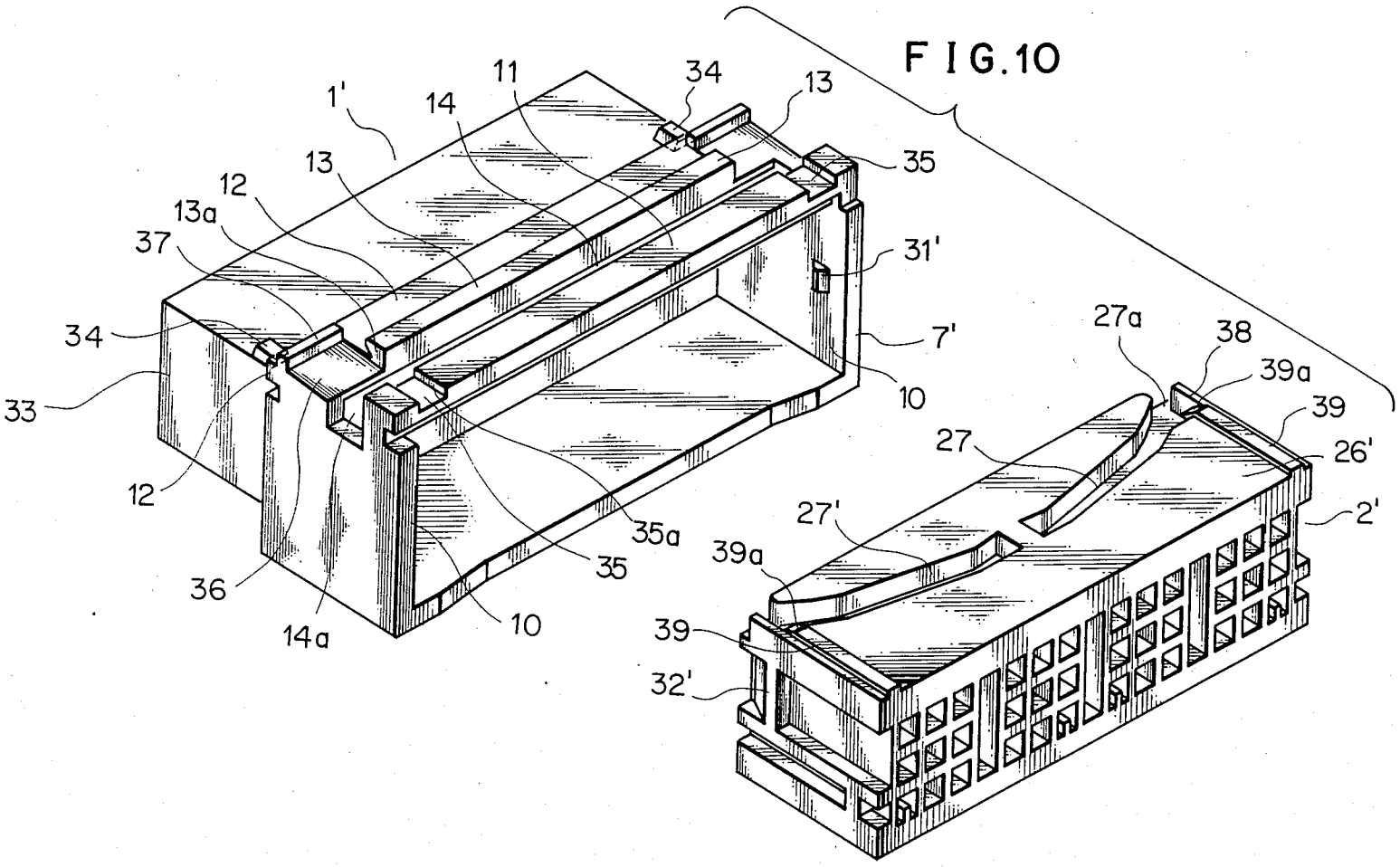
FIG. 10 is an exploded perspective view showing the second embodiment of the same functional structure.
Figure 11:
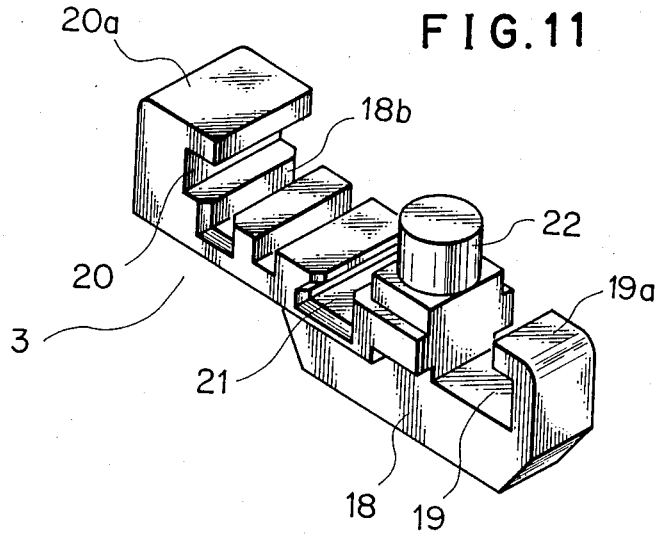
FIG. 11 is an expanded perspective view showing the slider in the same embodiment above.
Figure 16A:
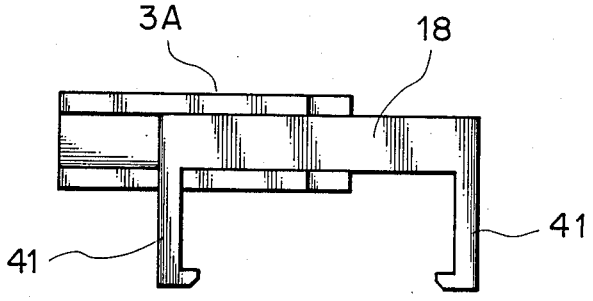
FIGS. 16A and 16B are respectively a plan view and the side view thereof.
Figure 16B:
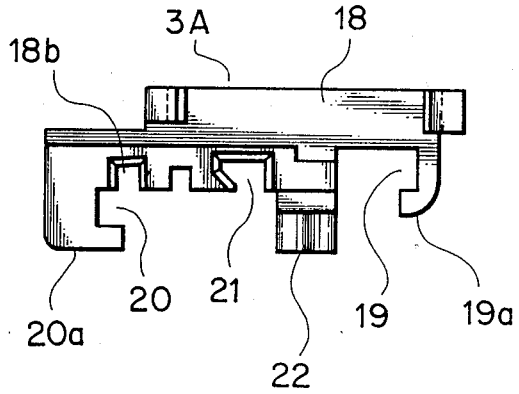

FIGS. 9A to 9C show cross sections of the cam follower and the cam track, in which the cam followers (a), (b), (c) are respectively shaped in a circular cone (FIG. 9A), a cylindrical body (FIG. 9B), and a trapozodial body (FIG. 9C), whereas their corresponding cam track (d) is shaped in a triangle (FIG. 9A) and other tracks (e) respectively have cross section of the trapozodial shape (FIGS. 9B and 9C). The most effective connection can be obtained by the case shown in FIG. 9C, in which the cam follower 34 and the cam track 36 are both trapozodial and this type of combination can also be aplied to the connection between the supporting rail 13 and the corresponding supporting groove 21.

The embodiment above is explained in the case which the cam tracks 27 and 27′ are connected to be a just one track, but each end portion 27*c* (27′) thereof can be separated from each other as well. Also, the angle of incliniation of the middle portion 27*b* can be formed as a constant one. Furthermore, the cam track can be formed as an arcuated semi-circular from the entrance portion 27*a* to the end portion 27C in order to acquire the smooth engagement and separation of the two housings. In addition, in the case that the slider 3 has enough rigidity, or that the number of polars is relatively small, in other words when the contact resistance is relatively large then the supporting rail 13 and supporting groove 21 corresponding thereto can be eliminated, and the guide rails 11, 12 and the insertion grooves 19, 20 each corresponding thereto can have the same function instead. In this case, the locking projections 15, 16 and 17 can be arranged on the guide rail side.

FIGS. 10, 11, and FIGS. 12A to 12D show the second embodiment of the first functional structure, in which the locking function of the pair of sliders at the open state can be much more secured.

In these figures, the enlarged body 7′ of the female housing 1′ is formed as a frame body of a rectangular parallelpiped shape which is rather bigger than the main body 33 of the housing itself, and a base plate 34 is protruding from the both upper ends thereof. Furthermore, a catching groove 35 for catching the slider 3 is formed at both ends of the guide rail 11 in the front portion of the enlarged body 7′ and a slope 36 formed at one end of the supporting rail 13 is gradually gets higher from the supporting rail 13 side backwardly towards the guide rail 12, and a guide projection 37 is arranged at the rear edge of the above slope for engaging with the concave portion 18*b* of the slider 3.

As for the cam track 27 (27′) formed in the upper wall 26′ of the male housing 2′, a respective side wall 38 is arranged at the both entrance 27*a* thereof, inside which a respective lock releasing projections 39 having a sloping surface 39*a* sloping down towards the above entrance 27*a* are also arranged.

By the way, a locking nail 31′ is arranged inwardly of the edge wall 10 of the enlarged body 7′ of the female housing 1′, and also a locking projection 32′ corresponding to the above locking nail 31′ is arranged at each of the side surfaces of the male housing 2′.

In the second embodiment above, it is same as the first embodiment that a pair of sliders 3 are mounted on the guide rails 11, 12 and the supporting rail 3 through an open inlet 14 of the slot 14, except that the sliders 13 can be securely locked when they reach the respective catching grooves 35 by the sliding movement thereof.

Figure 12A:
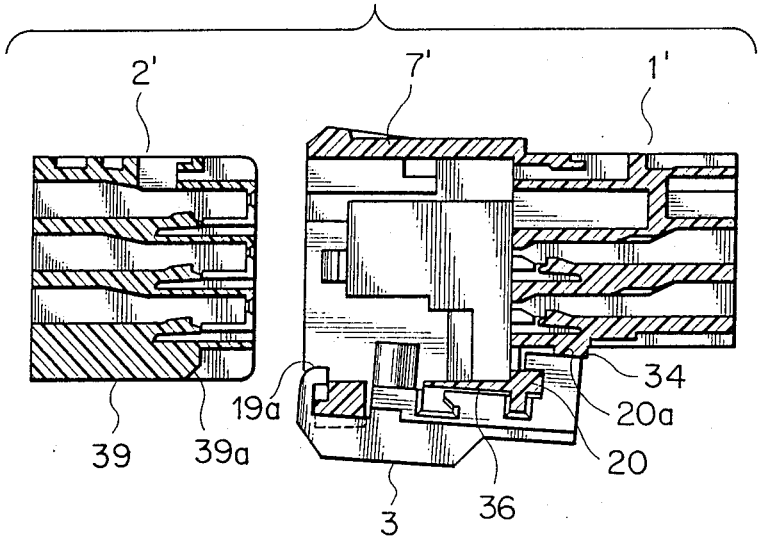
FIGS. 12A to 12D are sectional views each showing the function of the connection in the same embodiment.
Figure 12B:
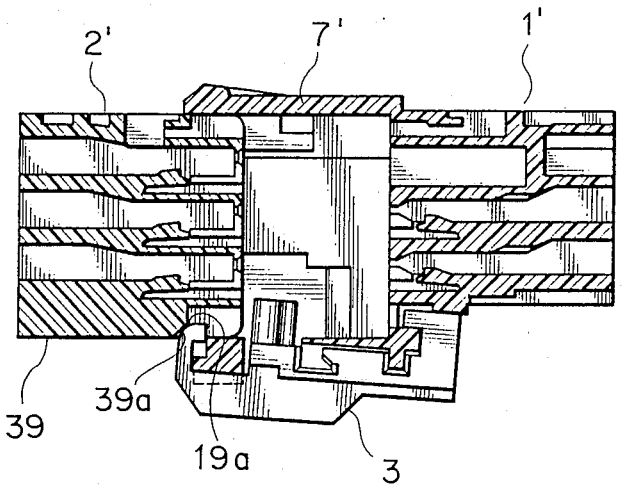

The above function is explained below referring to FIG. 12A. Firstly raise the rear portion of the slider 3 by the insertion groove 20 side, and place the bottom surface 20*a* thereof on the base plate 34. By this operation, the slider 3 is forwardly inclined on the slope 36 and the catching groove 35, whereby the side surface of the slider 3 is engaged with the side wall of the groove 35*a* of the above catching groove 35 and also engaged with the side edge surface 13*a* of the supporting rail 13, so that the slider 3 is securely locked.

In this state, when the male housing 2′ is inserted into the enlarged body 7′ of the female housing 1′, the sloping surface 39*a* of the lock releasing projection 39 reaches the bottom surface 19*a* of the insertion groove 19 located at the front portion side of the slider 3, so that the male housing 2′ promotes towards the above enlarged body 7′, raising the slider 3 at the same time.

Figure 12C:
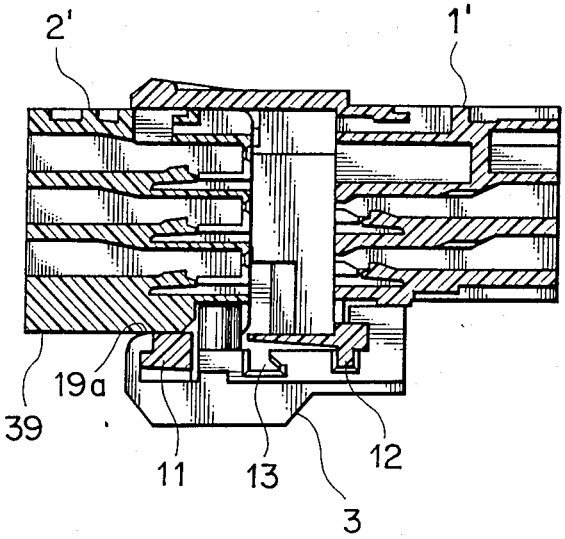

Here when the above locking projection 32′ of the male housing 2′ runs on the locking nail 31′ protruding inwardly of the enlarged portion of the female housing 1′ so as for the both housings to reach the engaging point, the bottom surface 19*a* of the slider 3 runs on the lock releasing porjections 39, so that the slider 3 stays in the horizontal state as shown in FIG. 12C. That is, the slider 3 is released from the engagement witht he above catching groove 35 and so on, and is permitted to slidably move along the guide rails 11, 12 and the supporting rail 13.

Figure 12D:
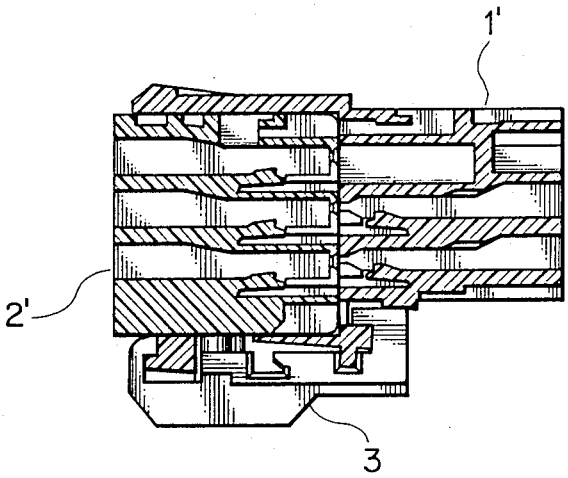

FIG. 12D shows the state in which the engagement of the two housings 1′ and 2′ has been completed. The engaging operation thereof by use of the slider 3 is same as tha tof the first embodiment as shown in FIGS. 6 to 8.

The separating operation thereof can be performed in the reverse operation to that of engaging, but since the slider 3 is stopped by the side wall 38 of the upper surface 26′ of the male housing 2′, it never comes off from the enlarged portion 7′.

According to the second embodiment as explained above, the slider 3 can securely be locked at the open state, the locking performance is quite effective, locking operation is fairly easy, and also the locking state is automatically released when the housing 1′ is engaged with the male housing 2′.

FIGS. 13A, 13B, and FIGS. 14A to 14C show the third embodiment of the first functional structure, in which the completion of the engagement of the both housings by use of a pair of sliders can be easily confirmed by an operator.

Figure 13A:
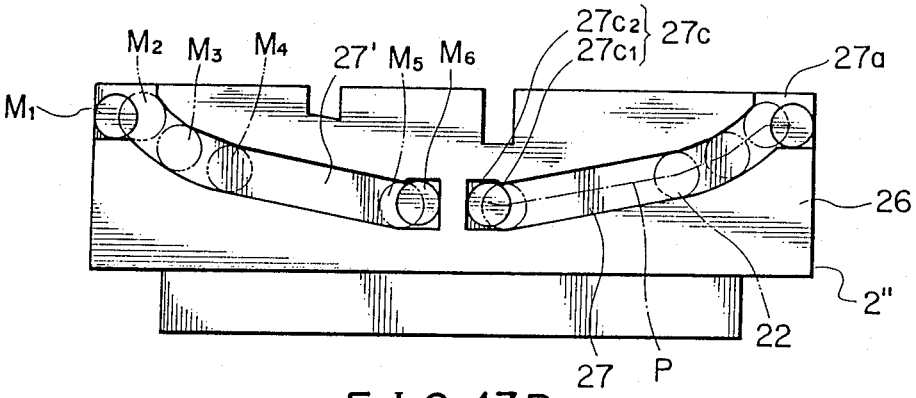
FIG. 13A is a plan view showing the male housing in the third embodiment.
Figure 13B:
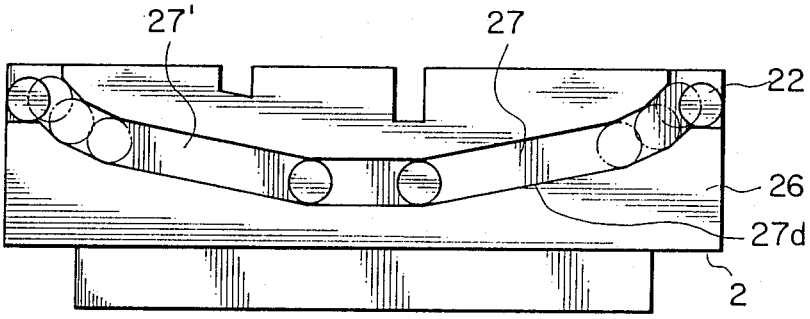
FIG. 13B is a plan view showing the male housing in the first embodiment in comparison with the same shown in FIG. 13A.

In FIG. 13A, the end portions 27*c* of the respective cam tracks 27 and 27′ in the male housing 2″ are separated by a separating wall 40, and each of the end portions 27*c* terminates at the wider portion 27*c*2 by arranging the narrow portion 27*c*1 at the end portion thereof. P denotes a locus of the cam follower 22 when the both housings are being engaged. FIG. 13B shows the relationship between the cam track 27 (27′) and the cam follower 22 in the male housing 2 of the first embodiment.

As explained above, the engagement of the female housing 1 and the male housing 2 is performed by the operation of the slider 3 (shown in FIGS. 6 to 8). In this case above, the cam follower 22 pushes the front side inner wall 27*d* of the cam track 27 as shown in FIG.

13B. Then when the engagement is completed, the slider 3 is locked by the above locking projection 17 (FIGS. 1 and 3), so as for the completion of the engagement is to be confirmed, but firmness thereof is not strong enough for the operator to feel it. Altough this firmness can be strengthened by arranging the locking projection 17 higher (or bigger), the slider becomes hard to operate and starts getting blocked at the locking position thereof, resulting in that the engagement is likely to be imperfect.

In order to improve the problems contained in the above embodiment, the third embodiment has been disclosed s below.

Figure 14A:
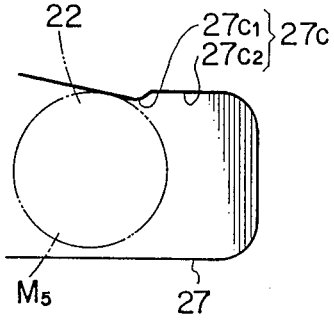
FIG. 14A to 14C are explanatory views each showing the expanded important portions as shown in FIG. 13A.
Figure 14B:
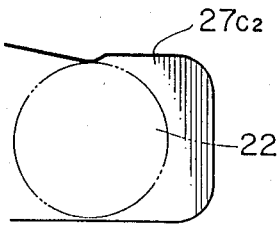
Figure 14C:
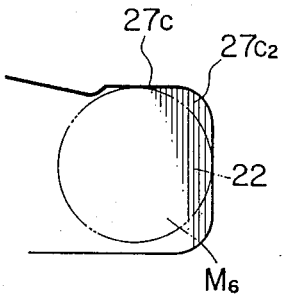
Figure 15A:
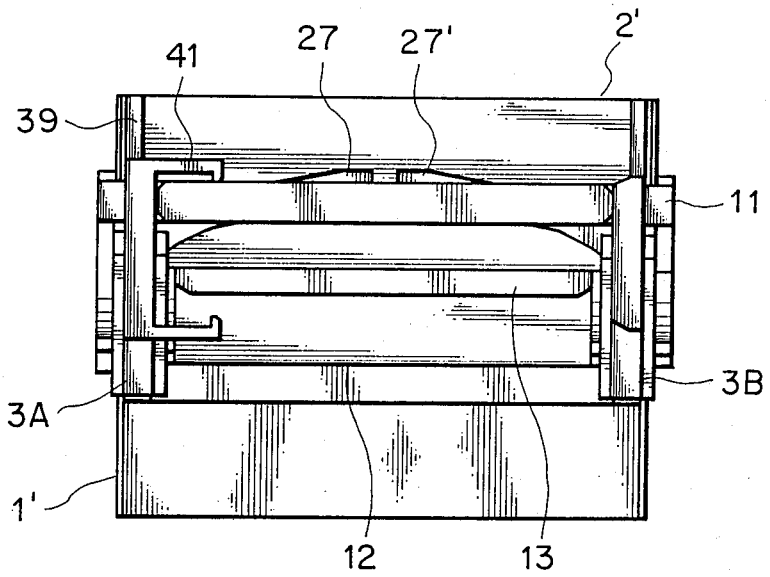
Figure 15B:
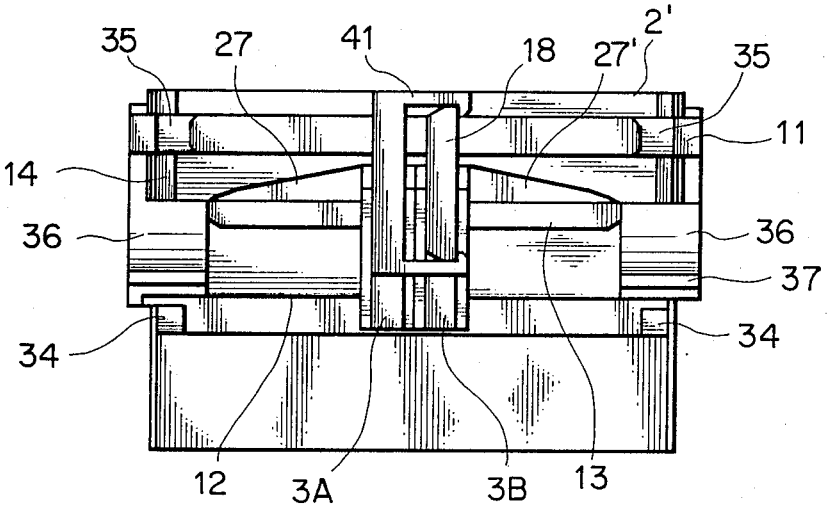
Figure 17A:
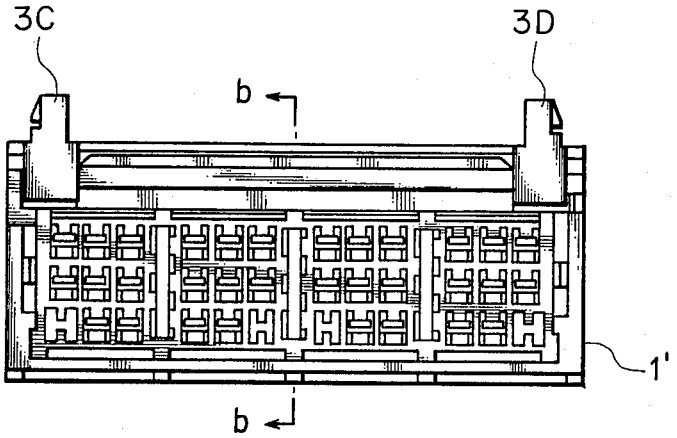
FIGS. 17A and 17B are respectively a rear side view of the female housing in the first embodiment of the second functional structure and the sectional view thereof cut along the line b—b.
Figure 17B:
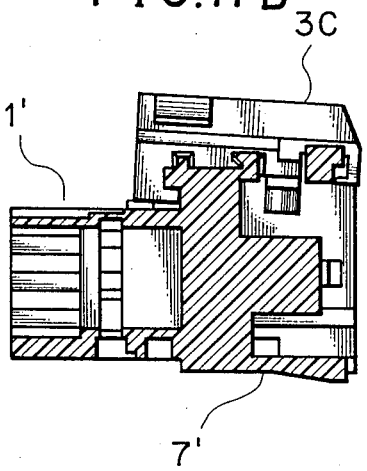

In FIG. 13A, the cam follower 22 transforms its position from the point M1 to M6, during which process the sliding resistance suddenly increases just before reaching the narrow postion 27c1 as shown in FIGS. 14a to 14C, and when it runs over this point, it is suddenly released to the wider position 27c2 making the above resistance remarkably small, whereby the operator can confirm the completion of the engagement with a moderate touch of resistance.

FIGS. 15A, 15B, and FIGS. 16A, 16B show the fourth embodiment of the first functional structure in which a locking means is arranged between the pair of sliders, so that the confirmation of the completion of the engagement and the retainment of the sliders at the closed state can be simultaneously performed.

As shown in these figures, the handle 18 of the slider 3A (the left slider in FIG. 15a) mounted on the female housing 1' is engaged at the both ends thereof with the handle of the slider 3B by use of a hook-like locking arm 41.

When the engagement of the housing 1' and 2' is completed by the above operation of 3A and 3B, the locking arm 41 is engaged with the hande portion 18 of the slider 3B so as to be locked, by which operation the sliders 3A and 3B are retained at the closed state so that the completion of the engagement can be confirmed.

Figure 18C:
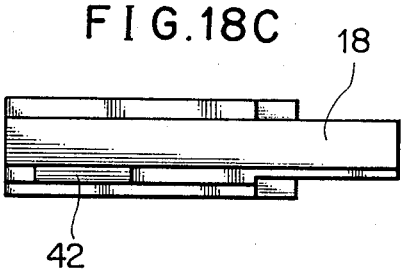
FIGS. 18A and 18B are respectively a front view of the slider as shown in FIGS. 17A and 17B, and the right side view thereof.
Figure 18A:
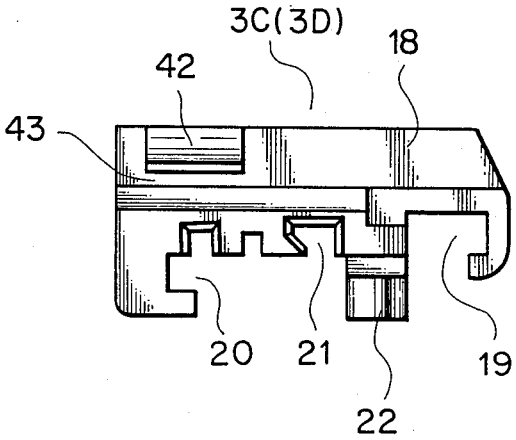
Figure 18B:
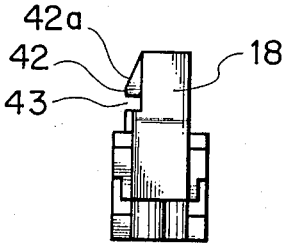
Figure 19:
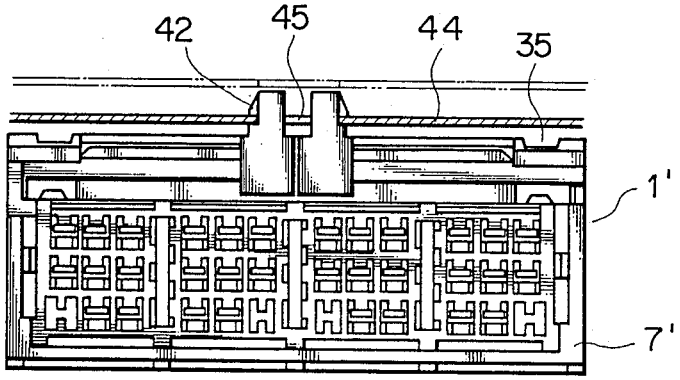
FIGS. 19 is an explanatory view showing the functional movement of the slider as shown in FIGS. 18A and 18B.

FIGS. 17A, 17B and FIGS. 18A, 18B, 18C, and also FIG. 19 show the first embodiment according to the second functional structure, in which a pair of sliders can be fitted into the hole of a panel or the like on the completion of the engagement of the both housings.

As shown in these figures, a locking nail 42 having a tapering slope in the outer surface of the handle 18 of each of the pair of sliders 3C and 3D is protrudedly formed and at the same time a panel engaging groove 43 is arranged underneath thereof. Other components of the slider 3C (3D) and the female housing 1 are same as those contained by the connector according to the second embodiment of the first functional structure (refer to FIGS. 10 and 12), but the same numeral used therein for explaining the components thereof are not explained here to prevent the repetition.

In this embodiment, by arranging a hole 45 in the wall 44 of another device such as a car body, a panel and so on as shown in FIG. 19, the locking nail 42 of each of the sliders 3C, 3D can be inserted into the above hole 45, so that the sliders are engaged with the above devices by the panel engaging groove 43. In other words, the confirmation of the completion of the engagement of the housings, the retainment of the sliders 3C, 3D at the closed state, and also locking of the housing can be simultaneously performed.

Figure 20A:
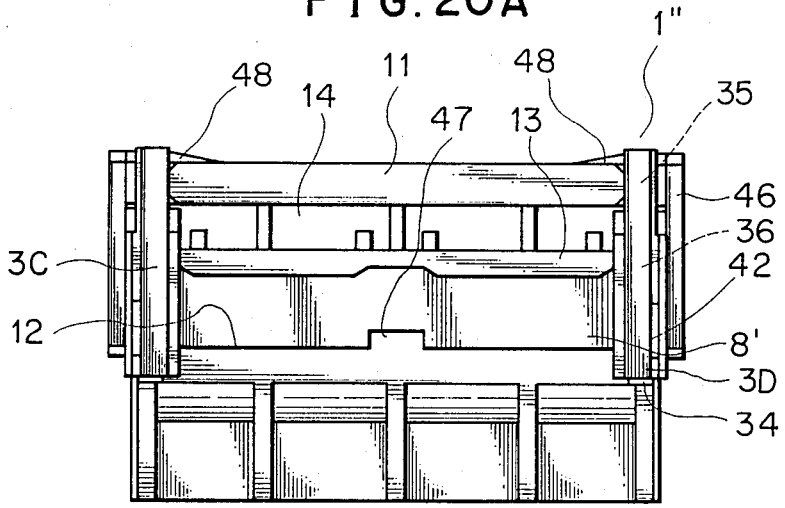
FIGS. 20A and 20B are respectively a plan view of the second embodiment of the same functional structure above and the front view hereof.
Figure 20B:
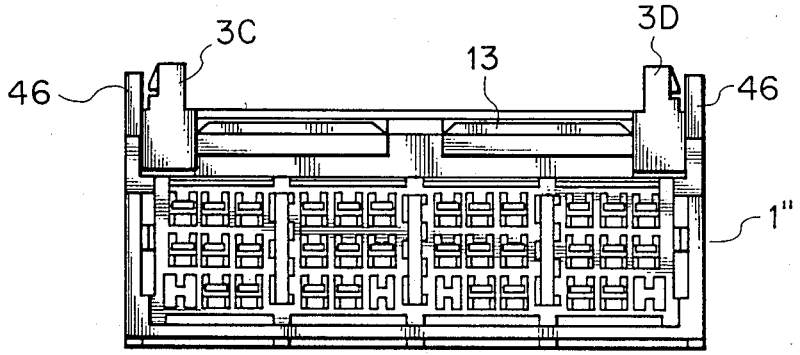
Figure 21A:
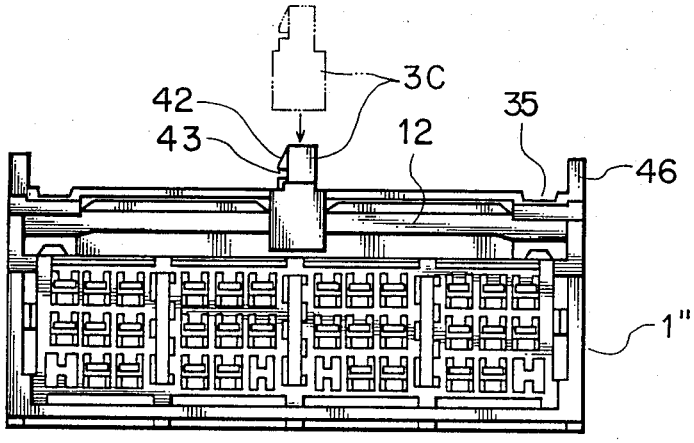
FIGS. 21A to 21C are explanatory views each showing the procedures for mounting the slider of the same above.
Figure 21B:
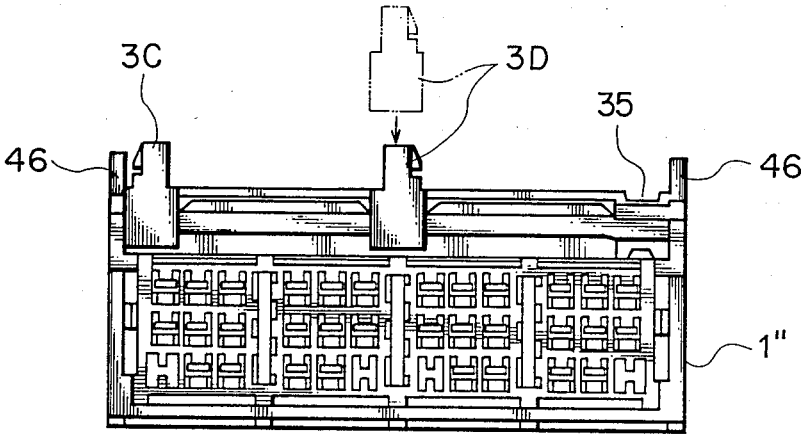
Figure 21C:
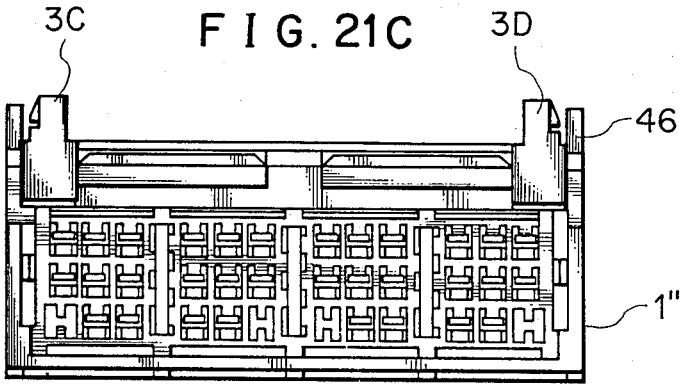
Figure 22:
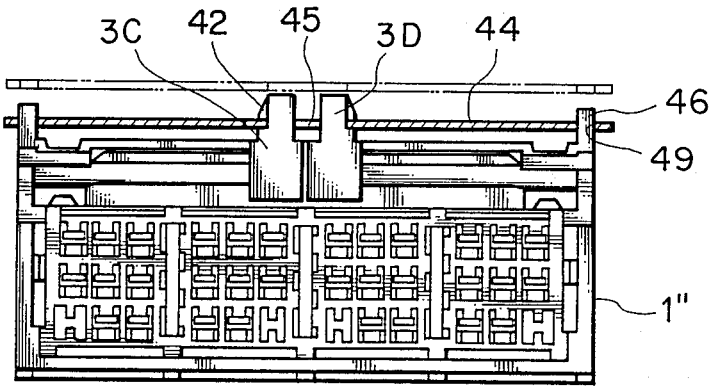
FIG. 22 is an explanatory view showing the functional movement of the same above.

FIGS. 20A, 20B, FIGS. 21A, 21B, 21C, and also FIG. 22 show the second embodiment fo the second functional structure. in which the sliders can be prevented from disengaging from the female housing, and the ricketiness upon engaging the housing with the above mentioned panel can also be eliminated.

As shown in these figures, a pair of sliders 3C, 3D are samely mounted on the female housing 1'', but as shown in FIGS. 20A, 20B, the level setting wall 46 which is as high as the level of the slider 3C, 3D at both ends of the upper edge wall 8' of the enlarged body 7' is protruded and the open inlet 14a of the slot 14 is thus closed, whereby a cut groove 47 is arranged in the middle portion of the rear guide rail 12 through which the sliders 3C (3D) are mounted. The width of the cut groove 47 is arranged in such a way for the slider 3C (3D) as to fit therein. Furthermore, the tapering slider catching means 48 is expandedly formed at both ends of the front guide rail 11.

In this embodiment, the slider 3C (3D) is mounted by the procedures in which it is first inserted through the cut groove 47 into the rear guide rail 12 as shown in FIG. 21A, and then the other one (slider 3D) is inserted as shown in FIG. 21B, the both sliders are mounted to each end of the guide rail 12, so that movements thereof are stopped by the locking means 48 as shown in FIG. 21C. Here, the both sliders are stopped at the forwardly inclining state thereof by the catching groove 35, the slope 36 and also by the base plate 34.

When the engagement of the housing is completed by use of the sliders 3C and 3D, the possible ricketiness of the engaged housings can be eliminated by inserted the level setting wall 46 into the slit 49 of the wall 44, after inserting the locking nail 42 of the sliders into the hole 45 of the wall 44 as shown in FIG. 22. If the sliders 3C, 3D are located at the closed state, they are not likely to be disengaged from the respective guide rails 11 and 12, as only one side of each slider runs on the above cut groove 47.

Figure 23:
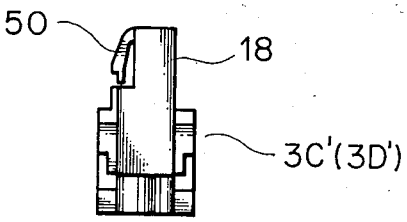
FIG. 23 is a plan view of the slider in the third embodiment of the same above.
Figure 24D:
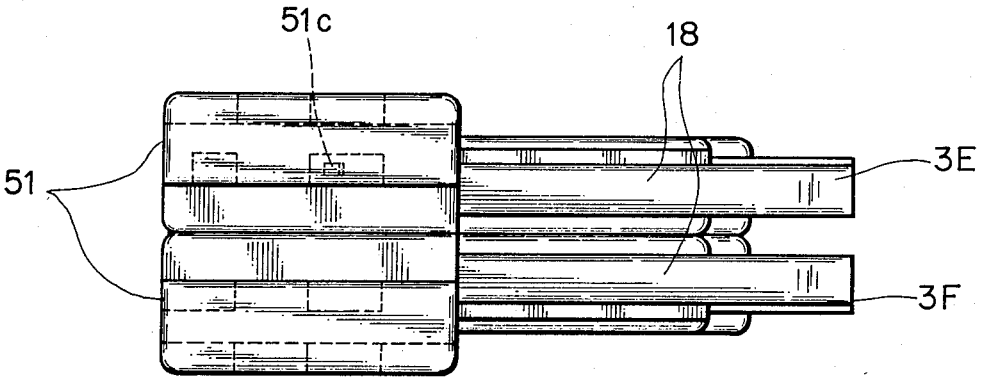
FIGS. 24A to 24D are respectively a front view of the pair of sliders in the fourth embodiment of the same above, the sectional side view thereof cut along the line b—b, the rear side view thereof and the plan view of the same.
Figure 24B:
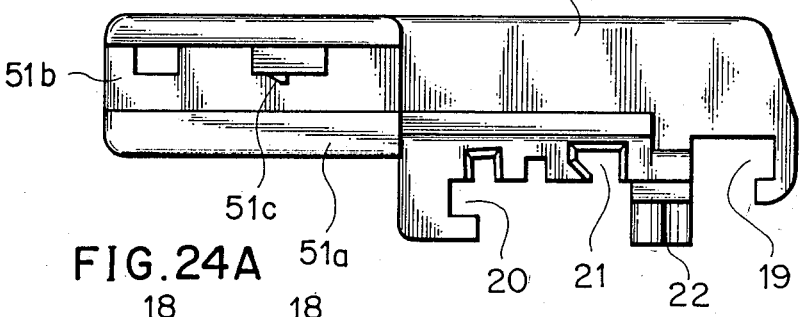
Figure 24A:
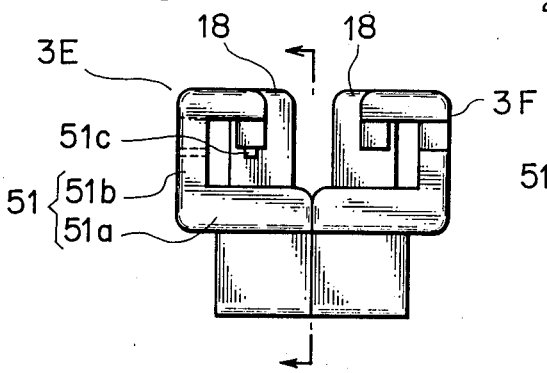
Figure 24C:
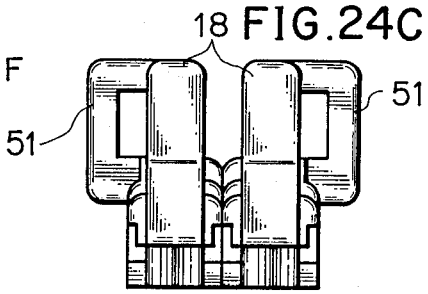

FIG. 23 shows the third embodiment of the same, in which a flexible clip nail 50 is arranged instead of the locking nail 42 of the slider 3C as shown in FIG. 18A. By use of the pair of sliders 3C' and 3D' respectively provided with the above clip nail 50, the housing can be removably locked against the hole 45 of the above wall 44 (FIG. 19), whereby checking, replacement and so on can be easily performed.

FIGS. 24A, 24B, 24C, 24D, FIGS. 25A, 25B, 25C, and FIG. 26 show the fourth embodiment of the second functional structure, in which an inserting type locking member for confirmation of the engagement is arranged to each of the sliders, so as to be remarkably attached to the receiving member arranged in the wall of a device such as a panel, an electric connection box and so on.

As shown in the figures above, each of the pair of sliders 3E, 3F contains a protruded locking member 51 at the rear portion of the handle 18 thereof which is composed of a base plate 51a and an intersector 51b having its cross section in the ⊐ shape, and a locking nail 51c protruding at the free end surface of the intersector 51b (FIGS. 24A to 24D). In the above case, the locking nail 51c should only be mounted on one of the sliders 3E and 3F.

Figure 25A:
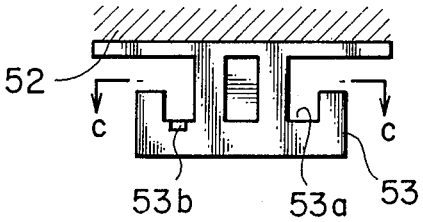
FIGS. 25A to 25C are respectively a front view of the receiving member for the sliders of the same above, and the side view thereof cut along the line c—c.
Figure 25B:
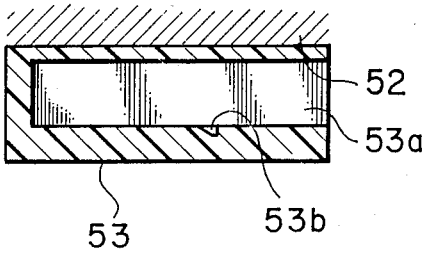
Figure 25C:
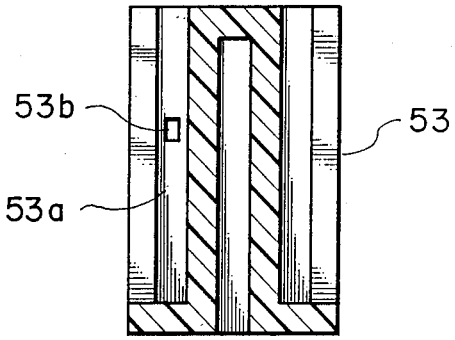
Figure 26:
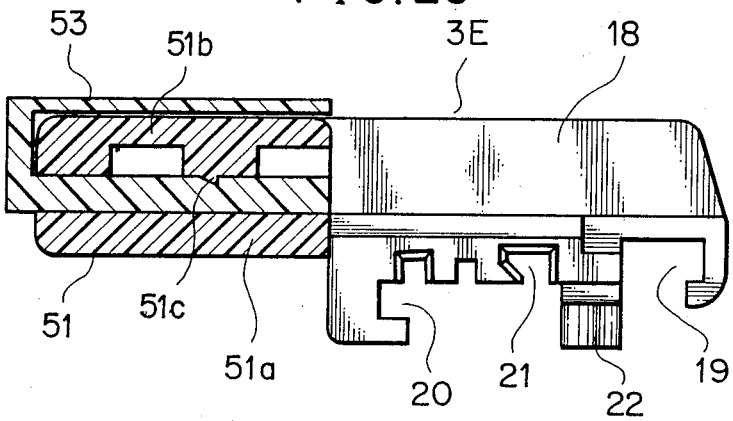
FIG. 26 is a partial sectional showing the engaging state of the slider and the receiving member of the same.

By the way in the wall surface of the electric connection box 52, a receiving member 53 having an insertion groove 53a for the above locking member 51 is protrudedly formed, and at the bottom surface of the insertion groove 53a, a locking groove 53b for engaging with the locking nail 51c is concavely disposed (FIG. 25A to 25C).

In this embodiment, when a pair of sliders 3E, 3F are contacted to each other, in other words, when they are at the closed state after the engagement of the two housings, the locking member 51 can be inserted into the receiving member 53, so that they are locked by the engagement of the locking nail 51*c* and the locking groove 53*b*.

EFFECT OF THE INVENTION

In a multi-terminal connector according to the present invention, since the slider composing a cam mechanism for engagement and separation of the male and female housings is already mounted on the female housing, it can be operated even in a limited narrow space. Furthermore, since the pair of sliders which symmetrically move between the open and the closed states, a smooth operation without ricketiness possibly caused by a rotational moment can be realized, and due to the above symmetrical movement of the sliders, the engagement and separation can be performed with a relatively small force.

Furthermore, due to the fact that the above connector is provided with a locking means for locking a pair of sliders at the open and closed state, there is no need to set the sliders at the initiating state for the engagement and thus imperfect engagement or separation of the two housings can be prevented.

Besides, by locking the perfectly engaged connector to the wall of a panel of a automovil or other electrical devides, the confirmation of the engaging state, prevention of the imperfect engagement and the locking of the two housings can be performed as well s the prevention of possible ricketiness during the vehicle is in operation.

What is claimed is:

1. A multi-terminal connector comprising, a male housing having a plurality of female terminals stored therein;

a female housing having a plurality of male terminals stored therein and provided with an enlarged body for accomodating said male housing;

a plurality of guide rails including at least two main guide rails and one supporting rail running in parallel therebetween disposed along the longer side of the enlarged body of said female housing, and also intersecting at right angles against the axis of said male terminals;

a pair of sliders each slidably engageable with said guide rails, having a cam follower downwardly projecting from the lower surface thereof;

a longitudinal slot formed between said at least two of rails for permitting each of said cam followers to protrude therethrough;

a pair of cam tracks arranged in the upper surface of said male housing and symmetrically extending in a diagonnally rearward direction from lateral ends thereof to engage with said respective cam followers through said slot.

2. A muilti-terminal connector claimed in claim 1, wherein said supporting rail is provide dwith three locking means on the upper surface thereof for retaining said pair of sliders; one in the center portion thereof and two at both ends thereof, said pair of sliders respectively having a projection arranged at the center portion of a groove disposed at the lower surface thereof to be engaged with said locking means.

3. A multi-terminal connector claimed in claim 2, wherein said pair of cam followers ca be shaped in any of a circular cone, a cylindrical and a trapozodial body.

4. A multi-terminal connector claimed in claim 3, wherein cross section of said cam track can be any shape of a triangle and a trapozodial.

5. A multi-terminal connector claimed in claim 4, wherein said cam track is composed of three different degrees of inclining angle $\theta$ 1, $\theta$ 2, and $\theta$ 3 in the sucessive order inwardly from the entrance thereof; wherein the acuteness of these three angles are defined as $\theta 1 > \theta 2 > \theta 3$.

6. A multi-terminal connector claimed in claim 5, wherein said female housing further comprises a plurality of guide shafts in the engaging surface thereof, said male housing further comprising a plurality of corresponding grooves to be engaged with said guide shafts.

7. A multi-terminal connector claimed in claim 6, wherein said male housing further comprises a locking nail which is protruded from each of the side surfaces thereof, said female housing further comprising a locking hole arranged in each of the side walls thereof to be engaged with said locking nails.

8. A multi-terminal connector claimed in claim 1, wherein said main guide rail located at the foremost portion of said enlarged body is provided with a catching groove formed in rectangular at each end thereof extending along the shorter side of said rail.

9. A multi-terminal connector claimed in claim 8, wherein said supporting rail is provided with a slope formated at one end thereof which is formed gradually getting higher in the backward direction.

10. A multi-terminal connector claimed in claim 9, wherein said slope is provided with a guide projection disposed in parallel with said main guide rail at the rearmost thereof.

11. A multi-terminal connector claimed in claim 10, wherein said pair of cam tracks are each provided with a lock releasing projection arranged at both ends of the upper surface of said male housing and having a sloping surface sloping down towards said each entrance thereof.

12. A multi-terminal connector claimed in claim 11, wherein said pair of cam tracks respectively further comprises a side wall extending from the entrance thereof along the outer side of said lock releasing projection.

13. A multi-terminal connector claimed in claim 12, whrein one of the webs of said respective sliders is provided with a lower surface whose foremost portion is in a curved shape, whereby said sliders can be slidably engaged with said rectangular shaped catching groove and slidably run on said lock releasing projection.

14. A multi-terminal connector claimed in claim 13, wherein said female housing further comprises a locking nail inwardly protruded from each side surface thereof, said male housing further comprising a locking projection at each side surface thereof for slidably engaging with said lock nail.

15. A multi-terminal connector claimed in claim 14, wherein said pair of cam tracks are separated from each other by a separating wall disposed between at each of the end portions thereof, these portions being arranged rather wider in size in comparison with other portions therof so as to facilitate the confirmtion of the engagement of said sliders.

16. A multi-terminal connector claimed in claim 15, wherein one of said sliders is provided with a handle having a hook-like locking arms at both ends thereof to be engaged with the other slider.

17. A multi-terminal connector claimed in claim 16, wherein said sliders have respectively a locking nail having a tapering slope with a panel engaging groove underneath thereof arranged in the outer surface of the handle portion of itself so as to be engaged with a hole in another device.

18. A multi-terminal connector claimed in claim 17, wherein said rearmost main guide rail is provided with a cut groove in the rear middle portion thereof through which said sliders can be mounted one by one.

19. A multi-terminal connector claimed in claim 18, wherein said enlarged portion of the female housing further comprises a level setting wall at both ends thereof closing the open inlet of said slot.

20. A multi-terminal connector claimed in claim 17, wherein said sliders have respectively a flexible clip nail instead of said locking nail so as to facilitate the replacement of said sliders.

21. A multi-terminal connector claimed in claim 19, wherein said pair of sliders are respectively provided with a protruded locking member at the rear portion of the handle thereof, a base plate and an intersector which contains a locking nail protruding at the free end surface thereof.

* * * * *